US010263379B2

(12) United States Patent
Wang

(10) Patent No.: US 10,263,379 B2
(45) Date of Patent: Apr. 16, 2019

(54) LARGE DEFLECTION CANTED COIL SPRINGS, CONNECTORS, AND RELATED METHODS

(71) Applicant: Bal Seal Engineering, Inc., Foothill Ranch, CA (US)

(72) Inventor: David Wang, Tustin, CA (US)

(73) Assignee: Bal Seal Engineering, Inc., Foothill Ranch, CA (US)

( * ) Notice: Subject to any disclaimer, the term of this patent is extended or adjusted under 35 U.S.C. 154(b) by 0 days.

(21) Appl. No.: 15/926,903

(22) Filed: Mar. 20, 2018

(65) Prior Publication Data

US 2018/0278005 A1 Sep. 27, 2018

Related U.S. Application Data

(60) Provisional application No. 62/476,353, filed on Mar. 24, 2017.

(51) Int. Cl.

| | |
|---|---|
| ***H01R 13/187*** | (2006.01) |
| ***H01R 43/20*** | (2006.01) |
| ***H01R 13/41*** | (2006.01) |
| ***H01R 13/08*** | (2006.01) |
| ***H01R 13/426*** | (2006.01) |
| *H01R 13/24* | (2006.01) |

(52) U.S. Cl.

CPC ..... *H01R 43/20* (2013.01); *H01R 13/08* (2013.01); *H01R 13/187* (2013.01); *H01R 13/41* (2013.01); *H01R 13/426* (2013.01); *H01R 13/2421* (2013.01)

(58) Field of Classification Search

CPC ..... H01R 13/187; H01R 13/2421

See application file for complete search history.

(56) References Cited

U.S. PATENT DOCUMENTS

| | | | |
|---|---|---|---|
| 3,174,500 | A | 3/1965 | Johnson et al. |
| 4,678,210 | A | 7/1987 | Balsells |
| 4,872,710 | A | 10/1989 | Konecny et al. |
| 5,411,348 | A | 5/1995 | Balsells |
| 5,545,842 | A | 8/1996 | Balsells |
| 5,570,719 | A | 11/1996 | Richards et al. |
| 6,672,565 | B2 | 1/2004 | Russell |
| 6,835,084 | B2 | 12/2004 | Poon et al. |
| 7,538,289 | B2 | 5/2009 | Carroll |
| 7,722,415 | B2 | 5/2010 | Changsrivong |
| 7,914,315 | B2 | 3/2011 | Kuhn et al. |
| 7,914,351 | B2 | 3/2011 | Balsells et al. |
| 8,052,459 | B2 | 11/2011 | Smith et al. |

(Continued)

FOREIGN PATENT DOCUMENTS

| | | |
|---|---|---|
| DE | 19807663 | 9/1999 |
| GB | 2194298 | 3/1988 |
| WO | WO 03067713 | 8/2003 |

*Primary Examiner* — Tho D Ta

(74) *Attorney, Agent, or Firm* — Klein, O'Neill & Singh, LLP

(57) ABSTRACT

A connector assembly having a housing and pin and a spring contact located therebetween to take up a set gap between the pin and the housing. The spring contact can be a canted coil spring and the spring contact can be made to have a large range of deflection to take up the gap with a large range of variation, such as when the pin diameter varies for a given groove bore diameter or when the groove bore diameter varies for a given pin diameter.

21 Claims, 7 Drawing Sheets

(56) References Cited

U.S. PATENT DOCUMENTS

| | | | | |
|---|---|---|---|---|
| 8,096,842 | B2 | 1/2012 | Poon et al. | |
| 8,308,167 | B2 | 11/2012 | Balsells et al. | |
| 8,382,532 | B2 | 2/2013 | Sjostedt et al. | |
| 8,491,346 | B2 | 7/2013 | Sjostedt et al. | |
| 8,561,274 | B2 | 10/2013 | Balsells | |
| 9,004,805 | B2 | 4/2015 | Changsrivong et al. | |
| 9,267,526 | B2 | 2/2016 | Balsells | |
| 9,284,970 | B2 | 3/2016 | Dilmaghanian et al. | |
| 9,312,630 | B2 | 4/2016 | Huang | |
| 9,482,255 | B2 | 11/2016 | Changsrivong et al. | |
| 9,500,211 | B2 | 11/2016 | Changsrivong | |
| 9,534,625 | B2 | 1/2017 | Balsells | |
| 9,677,587 | B2 | 6/2017 | Changsrivong et al. | |
| 2001/0018298 | A1* | 8/2001 | Nakamura | H01R 13/187 439/841 |
| 2002/0122690 | A1 | 9/2002 | Poon et al. | |
| 2003/0096526 | A1 | 5/2003 | Balsells | |
| 2011/0062640 | A1* | 3/2011 | Leon | B21F 1/00 267/166 |
| 2013/0149031 | A1 | 6/2013 | Changsrivong et al. | |
| 2016/0076568 | A1* | 3/2016 | Dilmaghanian | H01R 13/2421 403/271 |
| 2017/0373425 | A1* | 12/2017 | Rust | H01R 39/08 |

* cited by examiner

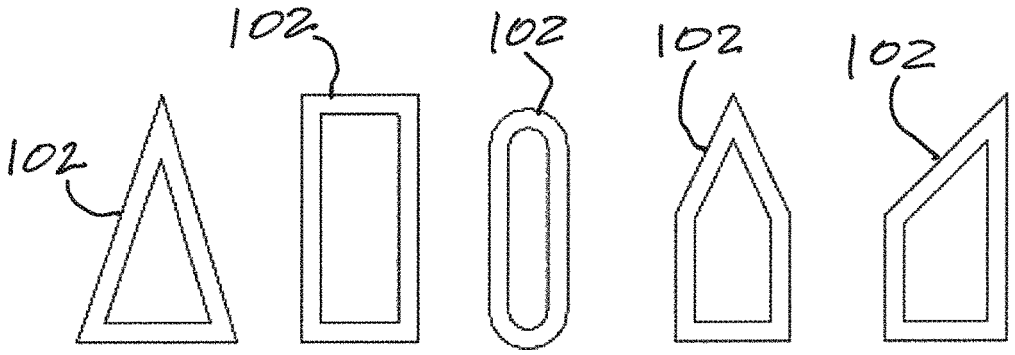
FIG. 11(a) 11(b) 11(c) 11(d) 11(e)
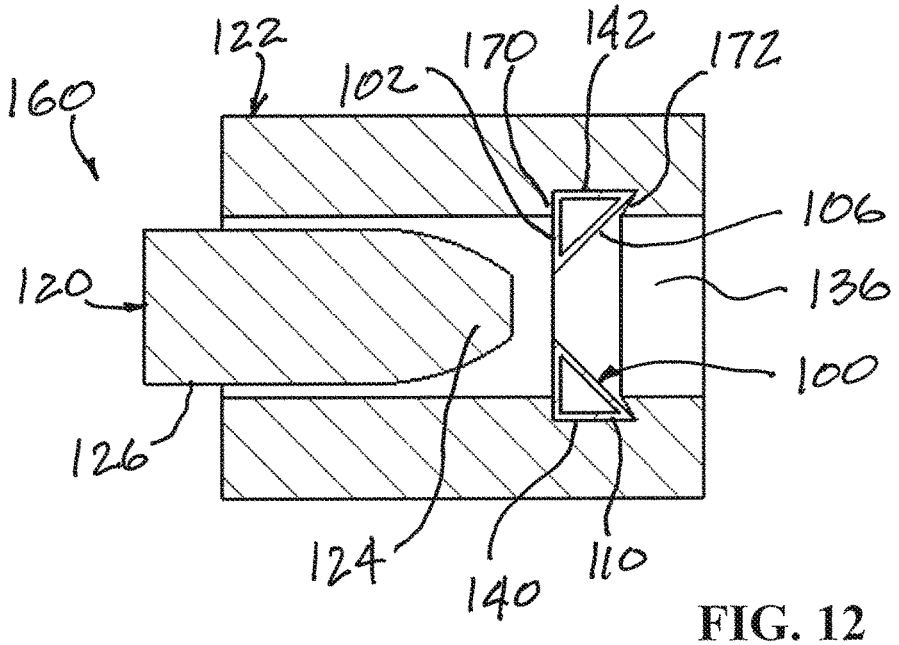
FIG. 12

LARGE DEFLECTION CANTED COIL SPRINGS, CONNECTORS, AND RELATED METHODS

FIELD OF THE INVENTION

The present invention generally relates to canted coil springs, canted coil springs for use with connectors, and related methods, are more particularly directed to canted coil springs with large range of deflection and connectors have large set gaps using such canted coil springs.

BACKGROUND

Conventional connectors are typically limited to a specific match of corresponding pin and housing sizes. In other words, a prior art connector is typically designed for a mating or matching pair of housing and pin. A set gap is typically found between such pin and housing. A spring contact may be located in a housing to establish connection between the pin and housing, such as to bridge the set gap. Conventionally, a spring contact connector requires a set gap between the pin and the housing that is appropriately sized to receive a spring contact therein so that the spring contact can operate within its designed deflection range or operating range.

In certain applications, there may be a desire to use a pin having a size that is not considered mating, matching or corresponding to the housing intended for connection. Typically, if a relatively smaller pin is to be connected to the housing having less than an optimal pin size, the set gap between the housing and the relatively smaller pin increases proportionally and may result in the need for a larger spring contact to be used to make up or bridge the gap.

However, there may be limitations when the set gap is larger than what a contact spring can provide. For example, the housing may not have a proper retaining groove large or deep enough to adequately secure or stably retain a conventional spring contact, such as a canted coil spring, needed to take up the larger than normal set gap. There may be further limitations in which a conventional spring contact, such as a canted coil spring, can no longer achieve contact with the pin due to a large increase in said gap. In other words, the larger than normal set gap can force the spring to operate outside of its operating deflection range and therefore cannot exert the appropriate spring force.

SUMMARY

The present invention provides a spring contact to establish connection between a housing and a pin wherein the gap between said housing and said pin may be relatively larger than a gap of a typical prior art connector. The gap between the interior of the housing and the exterior of the pin may be called a set gap. Furthermore, said spring contact may accommodate a wide range of pin sizes for a single housing with a particular housing groove diameter or a wide range of housing groove bores for a single pin. This present invention further provides a method in which contact may be established.

The invention introduced herein comprises a connector assembly comprising a spring contact. Said spring contact can be a canted coil spring contact in which a plurality of interconnected coils are all canted generally along the same direction and can further be canted when a loading force perpendicular to the coil axis, or axis passing through the center of each coil, is applied. Said canted coil spring contact can establish contact when a pin is inserted into a housing and the spring contact is positioned therebetween.

Within a wide operating range, the size of gap created between said pin and said housing, or set gap, can be taken up by a spring contact of the present invention to establish contact between said pin and said housing. This allows a given pin diameter to be operable with a range of housings having different bore sizes or for a given housing with a housing diameter to operate with a range of pin sizes.

The canted coil spring can have a plurality of interconnected coils each with a triangular shape and each having a coil base that can be located in a pin groove or a housing groove and the coil base contacting the bottom of said pin groove or housing groove. In other examples, the coils can have other shapes.

Aspects of the present are directed to a connector assembly comprising: a housing comprising a bore with a housing groove with a groove bore diameter X; a pin with a pin body comprising a pin diameter; a canted coil spring comprising a plurality of interconnected coils each with a coil base having a coil width and a coil height disposed in said bore of said housing; wherein said coil base is in contact with said housing groove; wherein said coil width is less than said coil height; wherein said pin is located in said bore of said housing and said plurality of interconnected coils of said canted coil spring are deflected along each respective coil height; wherein said plurality of interconnected coils contact said pin and said housing and are deflected along each respective coil height; and wherein the pin diameter is about 0.4X to about 0.89X.

The canted coil spring can be a triangular spring in which each coil of said plurality of interconnected coils can have a triangular shape with a coil base and a tipping joint.

Each coil of the canted coil spring can have a hypotenuse to provide an entry chamfer for the pin to facilitate insertion of the pin into the bore of the housing.

The pin can have a pin groove. The pin groove can be sized and shaped to accept or receive the tipping joint but not the coil base. Thus, the pin groove can have a smaller width than the width of the housing groove.

The width of the pin groove can have the same dimension or smaller than the width of the housing groove for a housing mounted connector. The width of the pin groove can have a dimension that is the same or larger than the width of the housing groove for a pin mounted connector.

The canted coil spring can latch onto said pin groove. The pin can be provided without a pin groove for use in a holding application with said housing and said spring contact.

A coil of a spring contact can have a coil base with a coil width and a length section with a coil height. The coil base can be in contact with a bottom surface of a housing groove for a housing mounted connector. The coil base can be in contact with a bottom surface of a pin groove for a pin mounted connector.

More broadly, a coil width of a coil of a spring contact can be in contact with a bottom surface of a housing groove for a housing mounted connector. The coil width of a coil of a spring contact can be in contact with a bottom surface of a pin groove for a pin mounted connector. The coil base can have a straight length. The coil height can have a length that is about 1.4 times to about 5 times larger than the length of the coil base.

The bottom surface of the housing groove can be located between two side walls and wherein at least one of the two side walls is angled relative to a lengthwise axis of the pin.

The tipping joint can be located in a pin groove of a pin to latch the pin to the housing.

The pin groove can have a width and the housing groove can have a width and wherein the width of the housing groove can be wider than the width of the pin groove or equal to the width of the pin groove. A coil can be located in both the pin groove and the housing groove. For a housing mounted connector, a larger section of the coil can be located in the housing groove than the pin groove. For a pin mounted connector, a larger section of the coil can be located in the pin groove than the housing groove.

The pin can be separable from the housing when the pin is moved in a second direction, which is opposite a first direction to latch the pin to the housing.

The coil base of a coil that is in contact with a housing groove or a pin groove can have a straight length, rather than a curve length typical in a coil with an elliptical shape.

Another aspect of the present invention is a method of making a connector assembly. The method can include making a connector with a housing for use with a range of pin sizes. The method can comprise: providing a housing with a bore and a housing groove having a groove bore diameter X; providing a canted coil spring comprising a plurality of interconnected coils each with a coil base having a coil width and a coil height disposed in said bore of said housing, wherein said coil base is in contact with said housing groove, and wherein said coil width is less than said coil height; inserting a pin having a pin diameter into the bore of said housing and deflecting said canted coil spring along the respective coil height of each of the plurality of interconnected coils; and wherein said canted coil spring is deflected by said pin and said housing and wherein said the pin diameter is about 0.4X to about 0.89X.

Another aspect of the present invention is a method of using a connector assembly as shown and described herein.

A still further aspect of the present invention is a connector assembly comprising: a housing comprising a bore with a housing groove with a groove bore diameter X; a pin with a pin body comprising a pin diameter and a pin groove disposed in said bore; a set gap between said housing and said pin; a canted coil spring comprising a plurality of interconnected coils each with a coil width and a coil height disposed in said bore of said housing; wherein said canted coil spring is located between said housing and said pin and in contact with said housing groove and said pin groove with said coil width of each coil in contact with said pin groove or said housing groove; wherein said coil width is less than said coil height; and wherein the pin diameter is about 0.4X to about 0.89X.

Other aspects of the present invention are shown and further described herein.

DESCRIPTION OF DRAWINGS

These and other features and advantages of the present devices, systems, and methods will become appreciated as the same becomes better understood with reference to the specification, claims and appended drawings wherein:

FIGS. 11(*a*) to 11(*e*) show alternative coil shapes that are usable as coils for spring contacts for use with contact assemblies.

FIG. 12 shows a cross-sectional side view of a connector assembly in which the housing groove has a tapered or angled side wall.

DETAILED DESCRIPTION

The detailed description set forth below in connection with the appended drawings is intended as a description of the presently preferred embodiments of connector assemblies and components provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1:
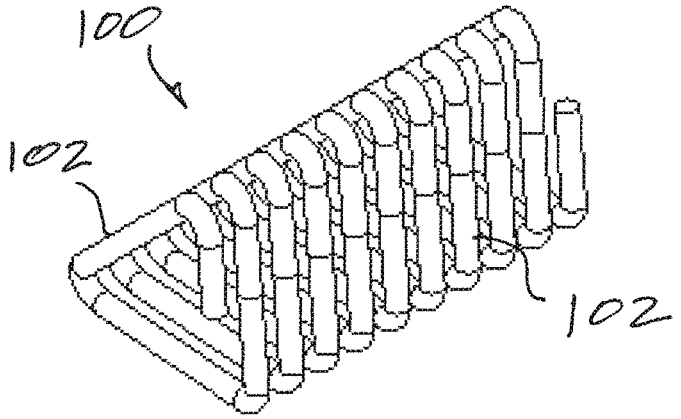
FIGS. 1 and 2 show two different views of a triangular spring length or section in accordance with aspects of the present invention. The end coils of the spring length can be connected to form a garter shape spring ring having a plurality of triangular spring coils.
Figure 2:
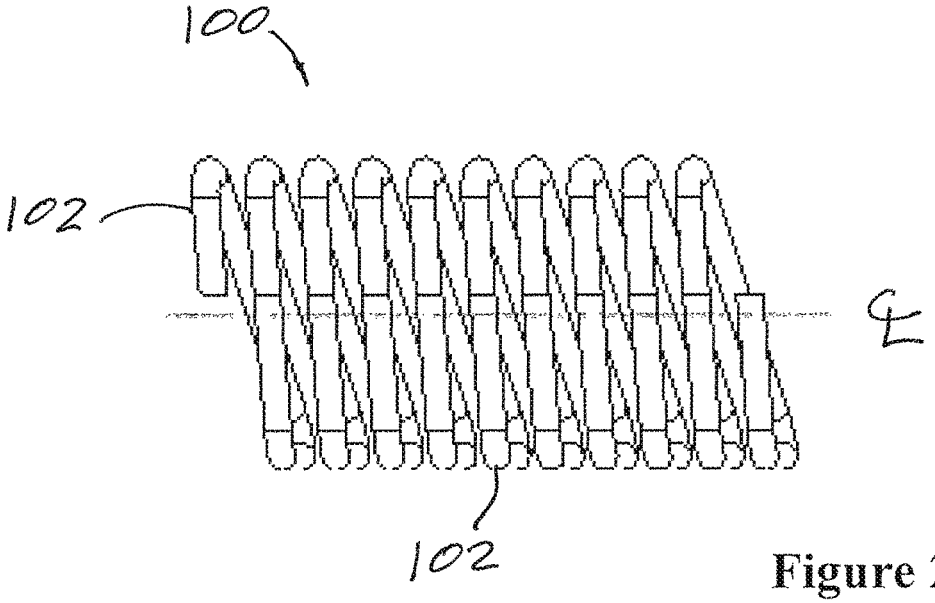

FIGS. 1 and 2 show two different views of a spring section or spring contact 100 in a spring length, with two separated ends that are not connected. In other examples, the spring section can be in a spring ring or garter configuration in which the two ends are connected or overlapped. Each coil of the plurality of coils of the spring section can be triangular in shape.

The spring section or spring contact 100 shown comprises a plurality of interconnected coils 102 that are all canted generally along the same direction relative to the coil axis passing through the centers of the coils 102, such as the coil centerline ℄ shown in FIG. 2. The coil centerline ℄ can be used as a reference point by which the deflection direction of the canted coil spring is based. For example, the coils 102 can all cant, such as by turning or coiling a wire during the formation stage of the spring length, in the direction that is left of FIG. 2. Opposing forces acting on the top and bottom of each coil 102, i.e., a force perpendicular to the coil centerline, will cause the coils 102 to further deflect or cant to the left of FIG. 2. In other examples, the coils 102 can cant to the right of FIG. 2.

The spring section 100 of a sufficient length has two end coils and in some embodiments, the end coils can be connected, such as welded, to form a spring ring or garter shape configuration. In other examples, the end coils can be overlapped to form a spring ring without welding. If the canted coil spring 100 is in a garter or ring configuration, then opposing forces acting on the outside diameter and inside diameter of the spring ring will cause the coils to deflect the same way as described with the spring length and the deflection can still be described with reference to the coil centerline.

The spring section 100 can be made from a metallic material. The metallic material can be a highly conductive material such as copper or brass or their alloys. The metallic material can instead be steel, which can be stainless steel, carbon steel or alloy steel. The metallic material can also be bare or can be plated or coated, such as with palladium, titanium, tungsten, or iridium. In other examples, the plated material can be a different material. For example, the coils can have a steel center with a copper or copper alloy outer plating or can be made from a copper or copper material with a steel outer plating.

Figure 3:
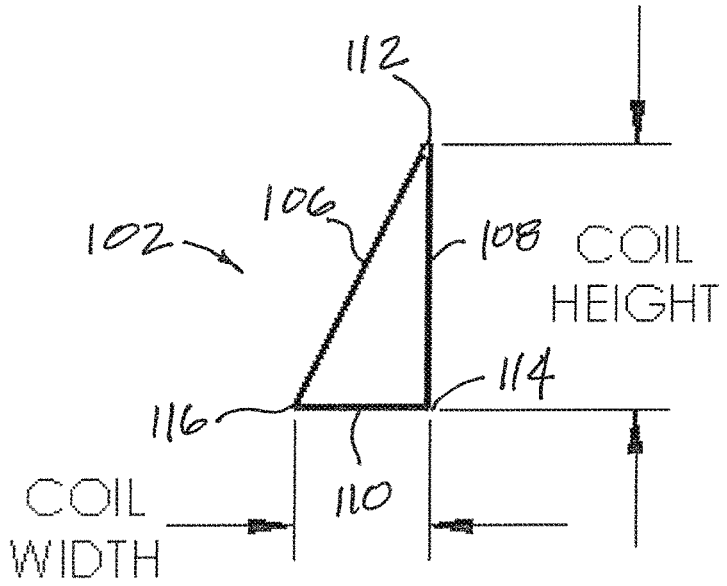
FIG. 3 shows an end view of a triangular spring coil of a spring length with labels to show the coil width and the coil height of the triangular spring coil.

FIG. 3 shows a schematic end view of a triangular shaped coil 102, which can represent one of the coils of FIGS. 1 and 2. As shown in FIG. 3, the coil width and coil height are both clearly labeled. The coil width may have a smaller size, such as a smaller value or dimension, compared to the dimension of the coil height. The coil 102 has three coil lengths 106, 108, 110 and three end joints 112, 114, 116 that join the three coil lengths. For discussion purposes, the end joint 112 at the top of the coil height may be referred to as a tipping joint, the coil length 110 at the opposite end can be referred to as the coil base, and the distance between the coil base and the tipping joint can be the coil height. The coil base has a straight length. The coil base 110 can have a length and the coil height can have a length and wherein the length of the coil height is about 1.4 times to 5 times greater than the length of the coil base. The ratio can change depending on the set gap of the connector assembly. The coil section 106 that is angled can be called the hypotenuse and can extend diagonally across two ends at an angle to the pin axis and therefore can be considered a diagonal coil section or diagonal length.

The canted coil spring, the pin, and the housing may be made from metallic materials, the materials can be conductive, and/or the materials can be coated or plated with one or more outer metallic layers. In an example, the coil 102 can be described as being triangle with a right angle or right triangle.

Figure 4:
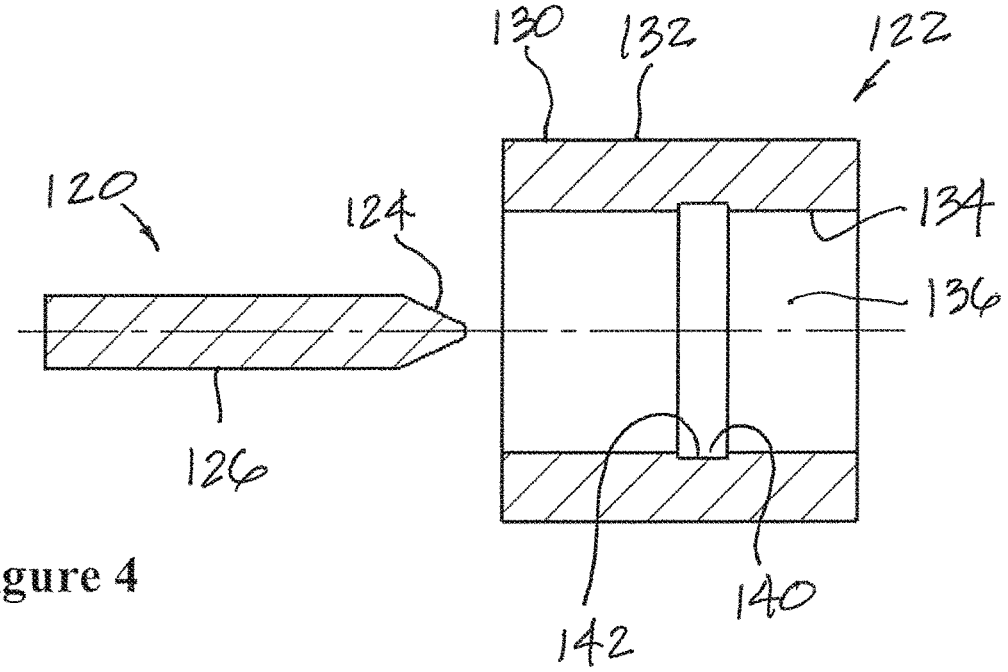
FIG. 4 shows a cross-sectional view of a pin and a housing with no spring contact in the spring groove inside the bore of the housing.

FIG. 4 shows a cross-sectional side view of a pin or rod 120 and a housing 122 with no spring contact. The pin 120 has a tapered insertion end 124 at an end of a pin body 126. The pin body has a length and a diameter, which is generally constant but can include varying diameter sections.

The housing 122 has a body 130 with an outside or exterior surface 132 and an inside or interior surface 134 defining a bore 136. The bore 136 has a bore diameter that can be selected depending on the desired or selected application. The bore 136 and/or the interior surface 134 is provided with a groove 140, such as a circumferential groove comprising a bottom surface 142 located between two sidewall surfaces. In other examples, the groove 140 can have other shapes, depths, widths and configurations. As further discussed below, the groove 140 can accommodate a spring ring to take up a set gap with a pin. The spring ring can have coils with large deflection capability to operate over a large set gap, as further discussed below.

As shown, the diameter of the pin 120 is less than 50% of the diameter of the bore 136 of the housing at the groove. In other examples, the diameter of the pin 120 can be greater than 50% of the diameter of the bore 136. In an example, the housing 122 with a bore diameter of X can be used in a connector application with a pin having a pin diameter of less than 0.5X, such as about 0.3X, and up to a diameter greater than 0.5X, such as up to about 0.9X. The bore diameter X can be understood as the diameter measured at the groove 140 located inside the bore 136 of the housing 122. This dimension can also be referred to as the housing groove bore diameter X, which is understood to mean a groove bore diameter having a diameter dimension of X.

If the coils 102 of the canted coil spring 100 are spaced appropriately, the range of diameter of the pin, or pin diameter, that can be used with a housing having a housing groove bore diameter can be about 0.3X to greater than 0.9X, such as 0.92X, where X can be the housing groove bore diameter, or the diameter of the bore 136 of the housing 122 measured at the groove 140.

The wide pin diameter range that is usable with a housing with a groove bore diameter of X can be made possible by utilizing a canted coil spring having a wide range of deflection of the present disclosure, as further discussed below. In an example, a preferred pin diameter of about 0.5X to about 0.89X is usable with a housing having a housing groove bore diameter of X and wherein the spring contact for use with the connector is of the large deflection type as disclosed herein.

Figure 5:
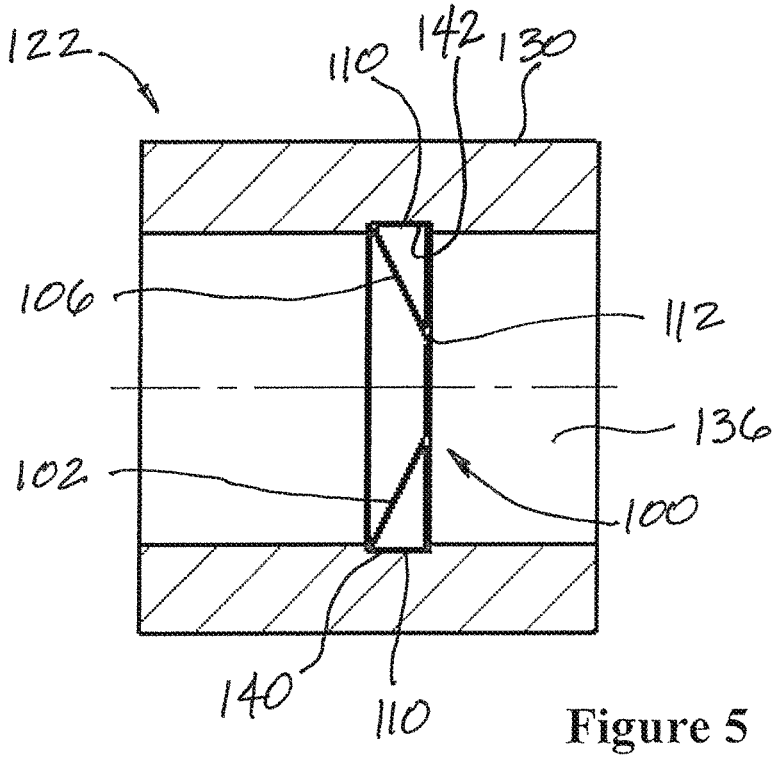
FIG. 5 shows a cross-sectional side view of a housing comprising a spring contact located inside a spring groove.

FIG. 5 shows a cross-sectional side view of a housing 122 comprising a spring contact 100 located in a spring groove 140 in the bore 136 of the housing body 130. The spring contact 100 can comprise a spring ring where two ends are overlapped or connected and having a plurality of interconnected canted coils 102 with each coil having a triangular shape, similar to the triangular shape coils 102 shown in FIGS. 1-3.

The various coil bases 110 of the plurality of coils 102 of the canted coil spring 100 can form a stable contact with the housing. More specifically, the bases 110 of the various coils 102 are in constant contact with the bottom surface of the groove 140 of the housing 122, and can form line contacts with the bottom surface of the housing groove. In an example, the coil base 110 of each coil are aligned widthwise with the width of the groove 140 so that the two ends of the coil base are located adjacent the two sidewalls of the groove 140. The diagonal side length 106 of the plurality of coils 102 can clearly be seen in FIG. 5.

Despite the relatively small area to contact between each coil base 110 and the groove surface 142 of the housing 122, the coils 102 can extend towards the center of the bore 136 such that they can contact a pin having a pin diameter of 0.3X or larger compared to a housing having a housing groove bore diameter of X.

Furthermore, the spring contact 100 of the present disclosure is able to be securely retained in the housing 122 compared to a large profile standard canted coil spring having coils with an elliptical shape. The stable contacts between the coil bases 110 of the plurality of coils 102 and the housing groove bottom surface 142, which can be viewed as line contacts or individually for each coil as a line contact, allow the spring contact 100 to retain itself in the groove 140 of said housing 122 whereas a canted coil spring with elliptical coils may be pushed out of the groove when used with a shallow groove. By shallow, the groove bottom surface relative to the opening to the groove is of a depth that only receives a fraction of a coil height placed therein.

In an example, the housing groove 140 has a depth that receives only the thickness or diameter of the wire that forms the coil base 110 of the triangular shaped coil 102 of the present embodiment up to about ten (10) times the diameter of the wire that forms the coil base. Obviously, the depth of the groove can be deeper than about 10 times the diameter of the wire that forms the coil base but the lower end of about 1 time the diameter of the wire used to form the coil base of the present invention is a unique feature of the present embodiment.

Figure 6:
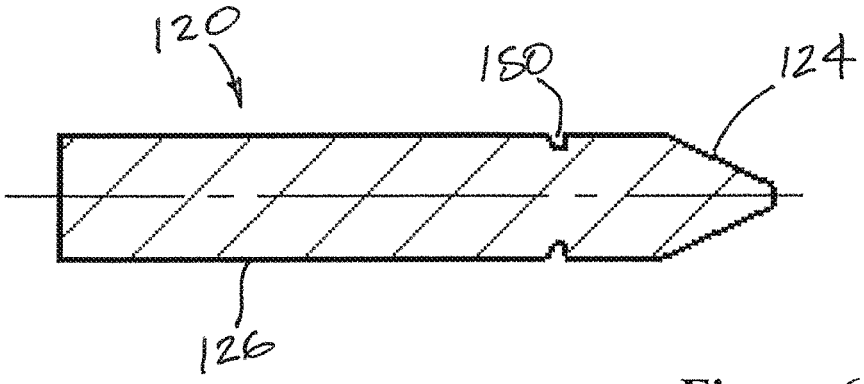
FIG. 6 shows a cross-sectional side view of a pin comprising of a groove.

FIG. 6 shows a cross-sectional side view of a pin 120 comprising a groove or pin groove 150 near the tapered insertion end 124. The groove 150 can provide a location or receiving surface where a spring contact 100 may establish contact with the pin when the pin is inserted into a bore of a housing having a spring contact described herein. In an example, the pin groove 150 can be symmetrical about a plane bisecting the groove in a direction orthogonal to the pin centerline. In other examples, the pin groove can be non-symmetrical. For example, if a tipping joint 112 of a spring coil 102 (FIG. 3) is not fully round, such as for a right-angle triangular shape coil, then the pin groove 150 can be similarly shaped to receive the not fully round tipping joint.

In other examples, the pin groove 150 can be oversized so as to accommodate a tipping joint of any shape, such as a fully round tipping joint or a not fully round tipping joint. Furthermore, the pin groove 150 may achieve either a latch connection, where after latching separation between the housing and the pin is permitted, or a locking connection, where after latching the pin and the housing cannot be separated without destroying the spring contact. The pin groove 150 can be provided with groove geometries that generate mostly axial component forces and none or little radial forces to deflect the coils to provide a locking connection between the pin groove and the spring contact. The pin 120 is shown with a pin body 126, which can be solid without any bore or passage through the body.

The pin groove 150 can have a width and wherein the width of the pin groove is smaller than the width of the housing groove 140. For a housing mounted connector, the width of the housing groove can be the same and up to about four times larger than the width of the pin groove. For a pin mounted connector, the width of the pin groove can be the same and up to about four times larger than the width of the housing groove.

Figure 7:
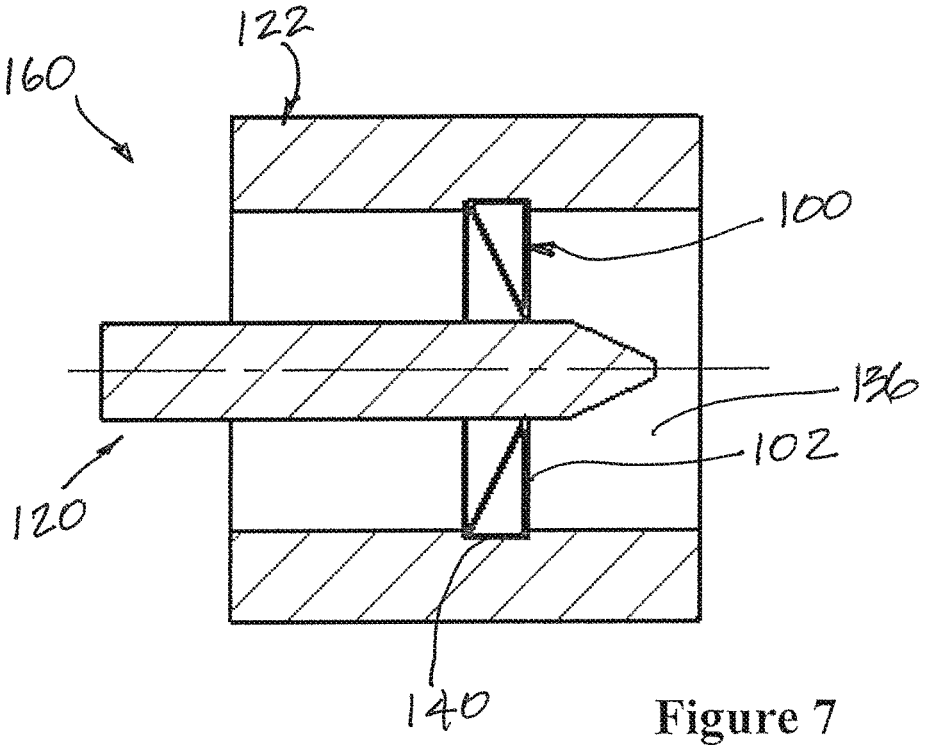
FIG. 7 shows a cross-sectional side view of a connector assembly in which a pin is located inside a bore of a housing and a spring contact is disposed therebetween.

FIG. 7 shows a cross-sectional side view of a connector assembly 160 comprising a housing 122, a spring contact 100, which can be in a spring ring configuration for use inside the housing groove, and a pin 120 located in a bore 136 of the housing, similar to those disclosed and described with reference to FIGS. 1-6. Despite the small pin diameter in which the diameter of the pin is less than 0.5X, such as about 0.3X to about 0.4X compared to the housing groove bore diameter X, the spring contact 100 can still establish a contact with the housing 122 and the pin 120. The spring contact 100 can establish contact with the housing and the pin despite the large set gap between the pin outer or exterior surface and the inside surface defining the bore of the housing.

In the connector assembly embodiment of FIG. 7, the pin 120 does not have an exterior pin groove and is therefore similar to the pin of FIG. 4. However, the pin of FIG. 7 can include a pin groove and can resemble the pin of FIG. 6.

For the connector assemblies and connector assembly components disclosed herein, it is understood that where a feature is shown but not expressly described and is otherwise the same or similar to the feature or features described elsewhere, such as above with reference to FIGS. 1-7, the disclosed part or parts shown in all the drawing figures but not expressly described because of redundancy and because knowledge is built on a foundation laid by earlier disclosures may nonetheless be understood to be described or taught by the same or similar features expressly set forth in the text for the embodiments in which the feature or features are described. Said differently, subsequent disclosures of the present application are built upon the foundation of earlier disclosures unless the context indicates otherwise. The disclosure is therefore understood to teach a person of ordinary skill in the art the disclosed embodiments and the features of the disclosed embodiments without having to repeat similar components and features in all embodiments since a skilled artisan would not disregard similar structural features having just read about them in several preceding paragraphs nor ignore knowledge gained from earlier descriptions set forth in the same specification. As such, the same or similar features shown in the following connector assemblies incorporate the teachings of earlier embodiments unless the context indicates otherwise. Therefore, it is contemplated that later disclosed embodiments enjoy the benefit of earlier expressly described embodiments, such as features and structures of earlier described embodiments, unless the context indicates otherwise.

Figure 8:
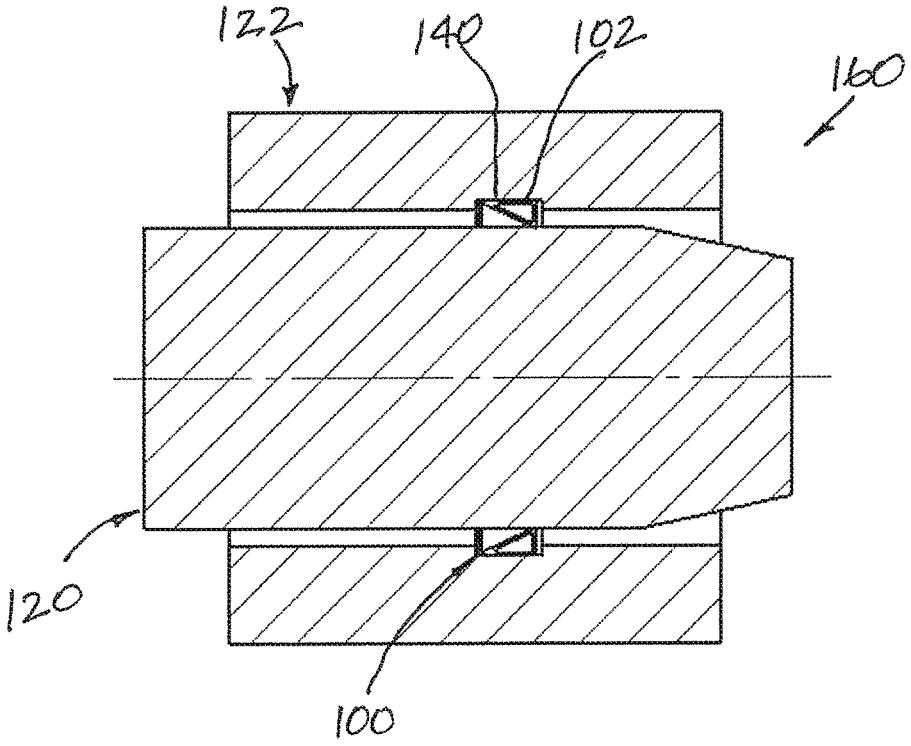
FIG. 8 shows a cross-sectional side view of a connector assembly with a relatively larger pin, diameter-wise, than the pin of FIG. 7.

FIG. 8 shows a cross-sectional side view of a connector assembly 160 comprising a housing 122, a spring contact 100, and a pin 120, similar to those disclosed and described with reference to FIGS. 1-6. In the present embodiment, the pin has a relatively larger pin diameter relative to a groove bore diameter X compared to the pin diameter of FIG. 7 relative to a groove bore diameter X of FIG. 7. In other words, the ratio of pin diameter to groove bore diameter of FIG. 8 is much larger than the ratio of pin diameter to groove bore diameter of FIG. 7.

In the embodiment of FIG. 8, the pin 120 can have a pin diameter of 0.7X up to about 0.9X compared to the bore 136 of the housing 122 having a bore diameter of X at the groove 140. Due to the relatively larger pin diameter of the present embodiment compared to the pin diameter of FIG. 7, and compared to a similarly sized housing with similar housing groove, the coils 102 of the spring contact 100 are in a more deflected state. The greater deflection of the individual coils 102 is due to the relatively larger diameter of the pin 120 of FIG. 8 compared to the housing groove bore diameter. This shows that the spring contact 100 is able to accommodate a wide range of pin sizes ranging from about 0.3X to about 0.9X for a housing having a groove bore diameter of X.

Figure 9:
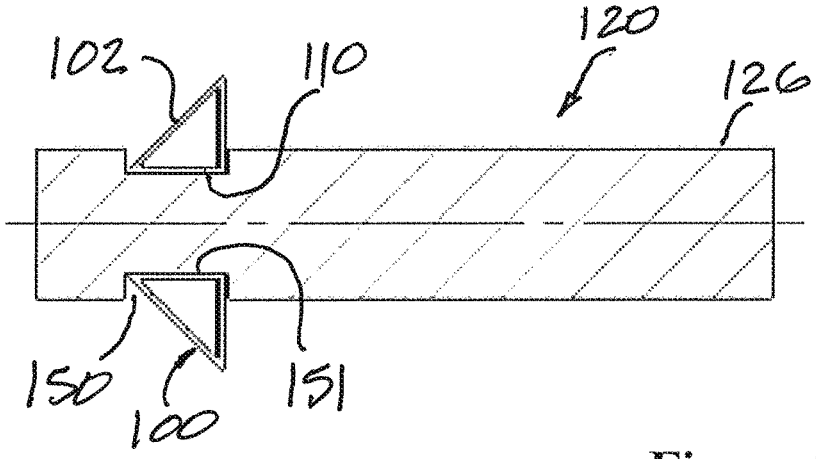
FIG. 9 shows a cross-sectional side view of a pin having a groove and the spring contact is located in the groove, and is piston mounted.

FIG. 9 shows a cross-sectional side view of a pin 120 having a pin body 126 and a pin groove 150. The present pin groove 150 is sized and shaped to function as a pin mounted connector. That is, for a connector assembly comprising a housing, a pin, and a spring contact, the spring contact 100 of the pin mounted connector is located in the pin groove 150 of the pin 120 prior to connecting the pin and the housing together with the spring contact therebetween. As a comparison, the connector assembly of FIGS. 5, 7, and 8 are housing mounted connectors in that the spring contact is located in the spring groove of the housing prior to receiving the pin inside the bore. Further, because the spring contact is mounted first to the pin in the present embodiment, a tapered insertion end can optionally be omitted from the pin as shown or one can be incorporated. At least one or both openings to the bore of the housing for use with the pin 120 and spring contact 100 should have an inlet taper to deflect the spring contact 100 along the outer edge or the tipping joints 112 (FIG. 3) of the coils 102 of the spring contact when the spring contact and pin are inserted into the bore of the housing to complete the connection.

As shown in FIG. 9, the spring contact 100 has a triangular geometry in that the plurality of interconnected coils 102 all have a triangular shape. The triangular shape coils can have different triangles and can be a right triangle with each having a hypotenuse. Said hypotenuse may act as an entry chamfer for said pin when inserting the pin into the bore of the housing. The coil base 110 of each coils can be arranged to contact the groove bottom 151 of the pin groove 150.

The pin and spring connector combination of FIG. 9 can accommodate a wide range of housing bore diameters. For example, if the pin diameter of the pin 120 is X, the bore diameter of the housing for use with the pin can be about 1.1X to about 2X with 1.2X to about 1.6X being more preferred, where X can be measured at the housing groove if incorporated or the inside surface defining the bore of the housing if no groove is incorporated.

As shown and described, a housing groove for receiving a spring contact in a housing mounted connector configuration, in which a spring contact is located in the housing groove before insertion of a pin, can have a groove bottom located between two sidewalls. The groove bottom can be generally parallel to a lengthwise axis through the bore of the housing. The two sidewalls can be generally parallel to one another and the groove cross-sectional side view can be described generally as having a U-shape. The spring contact can be one of the spring contacts 100 described elsewhere herein.

A pin groove for receiving a spring contact in a pin mounted connector configuration in which the spring contact is located in the pin groove before insertion of the pin into a bore of housing can have a groove bottom located between two sidewalls. The groove bottom can be generally parallel to a lengthwise axis of the pin. The two sidewalls can be generally parallel to one another and the groove cross-sectional side view can be described generally as having a U-shape. The spring contact can be one of the spring contacts 100 described elsewhere herein.

In some examples, the pin groove or housing groove can have a cross-sectional side view that is not generally U-shape.

With reference now to the connector assembly 160 of FIG. 10, the connector is shown with a housing 122, a spring contact 100, which can be in a spring ring configuration for use inside the housing groove 140, and a pin 120 located in a bore 136 of the housing, similar to those disclosed and described with reference to FIGS. 5-8 with some differences. In the present embodiment, the direction of insertion of the pin 120, which has a tapered insertion end 124, into the bore 136 of the housing 122 is different. Specifically, the pin 120 is inserted to contact the vertical lengths 108 of the plurality of coils 102 first rather than in the direction to contact the diagonal lengths 106 of the coils first, as is the case with FIGS. 7 and 8.

Figure 10:
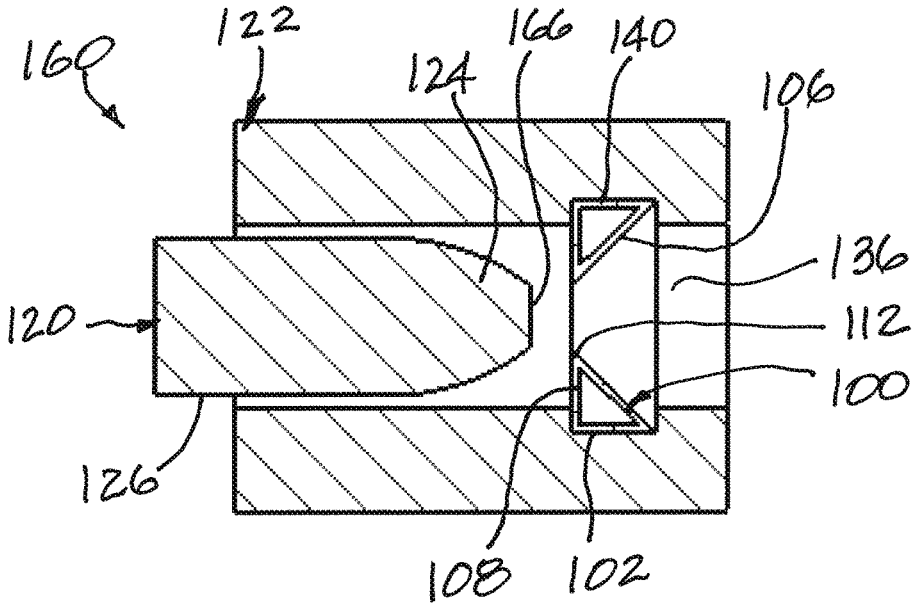
FIG. 10 shows a cross-sectional side view of a connector assembly in which the pin spring contact has been flipped or the direction of insertion of the pin has been changed.

Thus, the connector assembly 160 of FIG. 10 may be described as having a housing 122 with a housing groove 140 and wherein the spring contact 100 is flipped in orientation compared to the orientation of the spring contact of FIGS. 5, 7, and 8. Viewed different, the connector assembly 160 of FIG. 10 may be described as having a housing 122 with a housing groove 140 and wherein the spring contact 100 is orientated the same compared to the orientation of the spring contact of FIGS. 5, 7, and 8, but wherein the direction of insertion of the pin 120 into the bore 136 of the housing is flipped so that the pin tapered insertion end 124 approaches the vertical coil lengths 108 of the plurality of coils 102 first.

In the connector assembly of FIG. 10 and visualizing the pin 120 continued to be inserted into the bore 136 of the housing, after the distal most end surface 166 of the pin passes the inside diameter defined by the plurality of tipping joints 112 of the plurality of coils 102, the tapered insertion end 124 of the pin touches the coils 102 and cants the plurality of coils 102 in the direction perpendicular to the axis of the pin. In the present embodiment, the axis of the pin 120 can also be the ring axis of the spring ring 100. As the pin 120 continues further into the bore 136, the coils 126 continue to deflect to a maximum deflection at the largest diameter of the body 126 of the pin, if the pin does not incorporate a pin groove. If the pin incorporates a pin groove, the coils will deflect less than at the largest diameter of the pin body when the pin groove passes over the coils and the coils expand to seat within or project into the pin groove.

With reference now to FIGS. 11(*a*)-11(*e*), different coil shapes are shown that can be used in a spring contact 100 for use in a connector assembly with a large set gap of the present invention. Said differently, instead of a triangular shaped coil as shown in FIGS. 1, 2, 3, 5, and 7-10, the spring contacts 100 in those figures can incorporate coils having a coil shape as shown in FIGS. 11(*a*)-11(*e*). The coil 102 of FIG. 11(*a*) can be described as having a tall isosceles triangle shape. The two angled coil sections of the isosceles triangle of FIG. 11(*a*) can be called two diagonal sections or diagonal lengths. The coil 102 of FIG. 11(*b*) can be described as having a tall rectangle shape. The coil 102 of FIG. 11(*c*) can be described as having a tall oval shape. The coil 102 of FIG. 11(*d*) can be described as having a tall pentagon shape, or a tall gable shape. The coil 102 of FIG. 11(*e*) can be described as having a tall quadrilateral shape, or a tall trapezoid with only two parallel sides.

Each coil of the coils shown in FIGS. 11(*a*) to 11(*e*) has a coil width and a coil height. The coil width is configured to contact and align with a groove width that the coil comes into contact with, whether a housing groove or a pin groove. The coils of FIGS. 11(*a*), 11(*b*), 11(*d*) and 11(*e*) each has a coil base with a coil width having a straight length. Typical prior art canted coil springs with elliptical coils do not have the coil base with the coil width having the straight length shown. The coil of FIG. 11(*c*), being a tall oval shape, has a coil base with a coil width having an arcuate or curve length.

With reference now to the connector assembly 160 of FIG. 12, the connector is shown with a housing 122, a spring contact 100, which can be in a spring ring configuration for use inside the housing groove 140, and a pin 120 located in a bore 136 of the housing, similar to those disclosed elsewhere herein with some differences. In the present embodiment, instead of a housing groove 140 with a generally U-shape configuration, the housing groove 140 of the present embodiment has a groove bottom 142 and two side walls 170, 172, and wherein at least one of the two sidewalls, such as sidewall 172, is angled to correspond to the diagonal length 106 of the coils 102. The groove 140 of the present embodiment with one angled sidewall 172 may be referred to as a groove 140 with a half-dove tail or a half-dove tail groove. During installation, the coils 102 of the spring contact 100 with the diagonal lengths 106 should be oriented to be on the same side as the angled sidewall 172 of the housing groove 140.

For a pin mounted connector in which a spring contact is mounted first onto a pin groove of a pin, the pin groove of said pin may also incorporate a groove with a bottom wall and two side walls and wherein one of the side walls can be angled, similar to the housing groove of FIG. 12 but on a pin. The pin groove with one angled sidewall may be used with a spring contact having a plurality of coils and wherein each coil can have at least one diagonal length or diagonal coil section.

Figure 13:
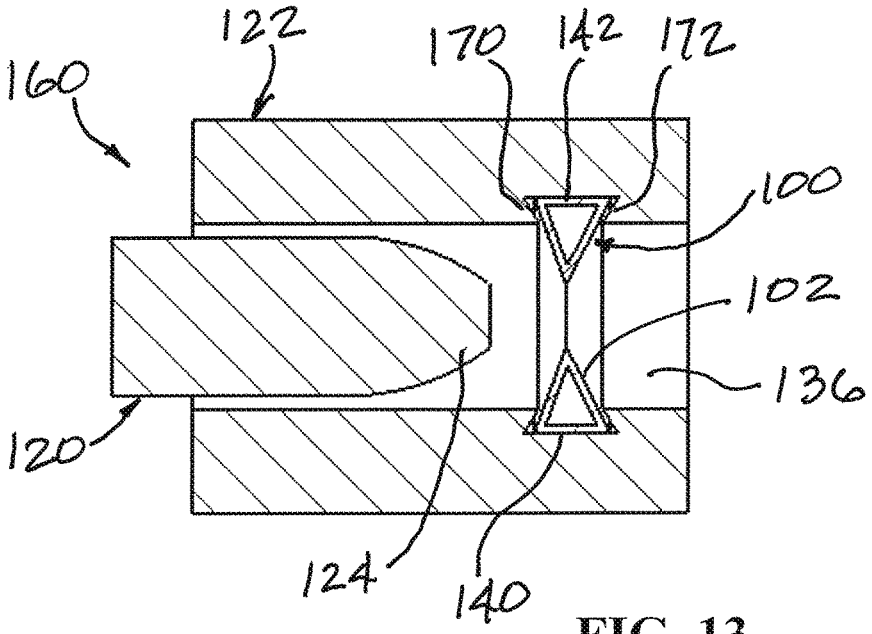
FIG. 13 shows a cross-sectional side view of a connector assembly in which the housing groove has two tapered or angled side walls.

With reference now to the connector assembly 160 of FIG. 13, the connector is shown with a housing 122, a spring contact 100, which can be in a spring ring configuration for use inside the housing groove 140, and a pin 120 located in a bore 136 of the housing, similar to those disclosed elsewhere herein with some differences. In the present embodiment, instead of a housing groove 140 with a generally U-shape configuration, the housing groove 140 of the present embodiment has a groove bottom 142 and two side walls 170, 172, and wherein both sidewalls 170, 172 are angled to correspond to the diagonal lengths of the coils 102, which can have a tall isosceles triangle shape of FIG. 11(*a*) with two diagonal lengths. The groove 140 of the present embodiment with two angled sidewalls 170, 172 may be referred to as a groove 140 with a full dove tail or a dove tail groove. During installation, the coils 102 of the spring contact 100 with two diagonal lengths 106 per coil 102 can be fitted into the dove tail groove 140 in any direction or orientation, due to the symmetrical nature of the groove and the coils.

While the pins 120 of FIGS. 12 and 13 are not shown with a pin groove, a pin groove may be incorporated, similar to that shown in FIG. 6.

For a pin mounted connector in which a spring contact is mounted first onto a pin groove of a pin, the pin groove of said pin may also incorporate a groove with a bottom wall and two side walls and wherein both side walls can be angled, similar to the housing groove of FIG. 13 but on a pin. The pin groove with two angled side walls may be used with a spring contact having a plurality of coils and wherein each coil can have two diagonal lengths or diagonal coil sections.

Methods of making and of using the connector assemblies and components thereof, such as the large deflection range canted coil springs, are within the scope of the present invention.

Although limited embodiments of the connector assemblies and their components have been specifically described and illustrated herein, many modifications and variations will be apparent to those skilled in the art. For example, the various connector assemblies may have pins that incorporate a pin groove where none is shown or can be of a different metallic material than described, etc. Furthermore, it is understood and contemplated that features specifically discussed for one connector embodiment may be adopted for inclusion with another connector embodiment, provided the functions are compatible. Accordingly, it is to be understood that the connector assemblies and their components constructed according to principles of the disclosed device, system, and method may be embodied other than as specifically described herein. The disclosure is also defined in the following claims.

What is claimed is:

1. A connector assembly comprising:

a housing comprising a bore with a housing groove with a groove bore diameter X;

a pin with a pin body comprising a pin diameter;

a canted coil spring comprising a plurality of interconnected coils each with a large range of deflection, a coil base having a coil width, and a coil height, said canted coil spring being disposed in said bore of said housing;

wherein said coil width has a length dimension that is less than a length dimension of said coil height;

wherein said pin is located in said bore of said housing and said plurality of interconnected coils of said canted coil spring are deflected along each respective coil height by said pin while each respective coil base contacts said housing groove; and wherein the canted coil spring with the plurality of interconnected coils each with the large range of deflection is configured to receive the pin diameter having any dimension within about 0.4X to about 0.89X.

2. The connector assembly according to claim 1, wherein the coil base has a straight length.

3. The connector assembly according to claim 1, wherein the coil height can have a length that is about 1.4 to about 5 times larger than a length of the coil base.

4. The connector assembly according to claim 1, wherein said canted coil spring is a triangular spring in which each coil of said plurality of interconnected coils has a triangular shape with the coil base and a tipping joint.

5. The connector assembly according to claim 4, wherein each coil has a hypotenuse providing an entry chamfer for said pin.

6. The connector assembly according to claim 4, wherein said pin has a pin groove with a width and wherein said housing groove has a width and wherein the width of the housing groove is wider than the width of the pin groove.

7. The connector assembly according to claim 1, wherein said pin comprises a pin groove.

8. The connector assembly according to claim 7, wherein said canted coil spring latches onto said pin groove.

9. The connector assembly according to claim 1, wherein said coil base is in contact with a bottom surface of said housing groove.

10. The connector assembly according to claim 9, wherein said bottom surface is located between two side walls and wherein at least one of the two side walls is angled relative to a lengthwise axis of the pin.

11. The connector assembly according to claim 4, wherein said tipping joint is located in a pin groove of the pin to latch the pin to the housing.

12. The connector assembly according to claim 11, wherein the pin is separable from the housing when the pin is moved in a second direction, which is opposite a first direction to latch the pin to the housing.

13. A method of making a connector assembly for use with a range of pin sizes comprising:

providing a housing with a bore and a housing groove having a groove bore diameter X;

providing a canted coil spring comprising a plurality of interconnected coils each with a large range of deflection, a coil base having a coil width, and a coil height, said canted coil spring being disposed in said bore of said housing and in said housing groove, and wherein said coil width has a length dimension that is less than a length dimension of said coil height;

inserting a pin having a pin diameter into the bore of said housing and deflecting said canted coil spring along the respective coil height of each of the plurality of interconnected coils by said pin while each respective coil base contacts said housing groove; and wherein the canted coil spring with the plurality of interconnected coils each with the large range of deflection is configured to receive the pin diameter having any dimension within about 0.4X to about 0.89X.

14. The method of claim 13, wherein said canted coil spring is a triangular spring in which each coil of said plurality of interconnected coils has a triangular shape with the coil base and a tipping joint.

15. The method according to claim 14, wherein each coil has a hypotenuse providing an entry chamfer for said pin.

16. The method according to claim 14, wherein said tipping joint is located in a pin groove of the pin.

17. The method according to claim 13, wherein said pin comprises a pin groove.

18. The method according to claim 17, wherein said canted coil spring latches onto said pin groove.

19. The method according to claim 13, wherein said coil base is in contact with a bottom surface of said housing groove.

20. The method according to claim 19, wherein said bottom surface is located between two side walls and wherein at least one of the two side walls is angled relative to a lengthwise axis of the pin.

21. A connector assembly comprising:

a housing comprising a bore with a housing groove with a groove bore diameter X;

a pin with a pin body comprising a pin diameter and a pin groove disposed in said bore;

a set gap between said housing and said pin;

a canted coil spring comprising a plurality of interconnected coils each with a large deflection range, a coil width defined by a straight segment, and a coil height disposed in said bore of said housing;

wherein said canted coil spring is located between said housing and said pin and in contact with said housing groove and said pin groove with said coil width of each coil in contact with said pin groove or said housing groove;

wherein said coil width is less than said coil height; and wherein the pin diameter has any dimension within about 0.4X to about 0.89X, and wherein the large deflection range of the plurality of coils of the canted coil spring deflects to accommodate the pin having the any dimension within about 0.4X to about 0.89X.

* * * * *